US008668548B2

(12) United States Patent
Liu

(10) Patent No.: US 8,668,548 B2
(45) Date of Patent: Mar. 11, 2014

(54) UNDERWIRE FOR A BRASSIERE

(75) Inventor: Zhen Qiang Liu, Kwai Chung (HK)

(73) Assignee: Regina Miracle International (Group) Limited, Hong Kong (HK)

( * ) Notice: Subject to any disclaimer, the term of this patent is extended or adjusted under 35 U.S.C. 154(b) by 322 days.

(21) Appl. No.: 13/069,776

(22) Filed: Mar. 23, 2011

(65) Prior Publication Data

US 2012/0196509 A1 Aug. 2, 2012

(30) Foreign Application Priority Data

Feb. 1, 2011 (CN) ..... 2011 2 0036274 U

(51) Int. Cl.
*A41C 1/14* (2006.01)

(52) U.S. Cl.
USPC ..... 450/41; 450/51

(58) Field of Classification Search
USPC ..... 450/41, 43–47, 51
See application file for complete search history.

(56) References Cited

U.S. PATENT DOCUMENTS

| | | | | |
|---|---|---|---|---|
| 3,351,954 | A * | 11/1967 | Chalfin et al. | 2/255 |
| 3,796,460 | A * | 3/1974 | Potchen | 297/211 |
| 5,967,876 | A * | 10/1999 | Kollmanthaler et al. | 450/41 |
| 6,544,101 | B1 * | 4/2003 | von Sydow et al. | 450/41 |
| 6,857,933 | B2 * | 2/2005 | Horta et al. | 450/41 |
| 7,677,950 | B2 * | 3/2010 | Mutschler | 450/41 |
| 8,087,972 | B2 * | 1/2012 | Mutschler | 450/41 |
| 2008/0293327 | A1 * | 11/2008 | Mutschler | 450/56 |

* cited by examiner

*Primary Examiner* — Gloria Hale
(74) *Attorney, Agent, or Firm* — Ostrolenk Faber LLP

(57) ABSTRACT

There is provided an underwire for a brassiere including: a plurality of linkage elements; each linkage element connected to at least one adjacent linkage element via a joint; at least one joint allowing for movement of the connected linkage element with respect to its adjacent linkage element; wherein movement of at least one connected linkage element with respect to its adjacent linkage element allows the underwire to more closely assume the curvature of a wearer's figure. A brassiere incorporating the improved underwire is also provided.

20 Claims, 5 Drawing Sheets

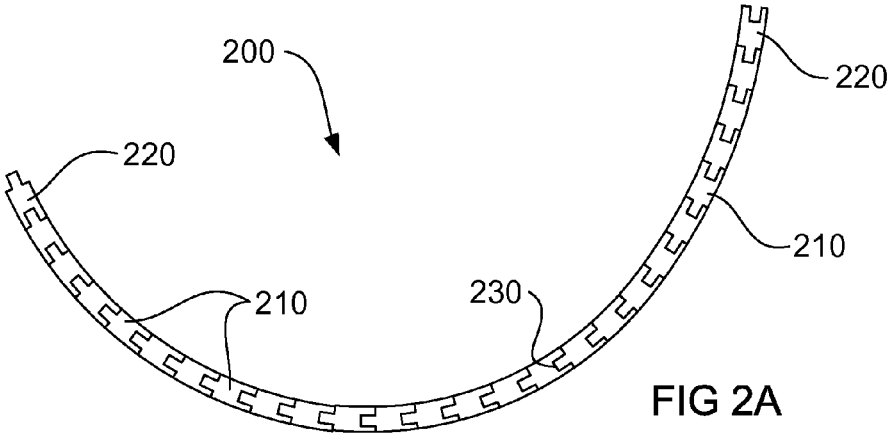
FIG 2A
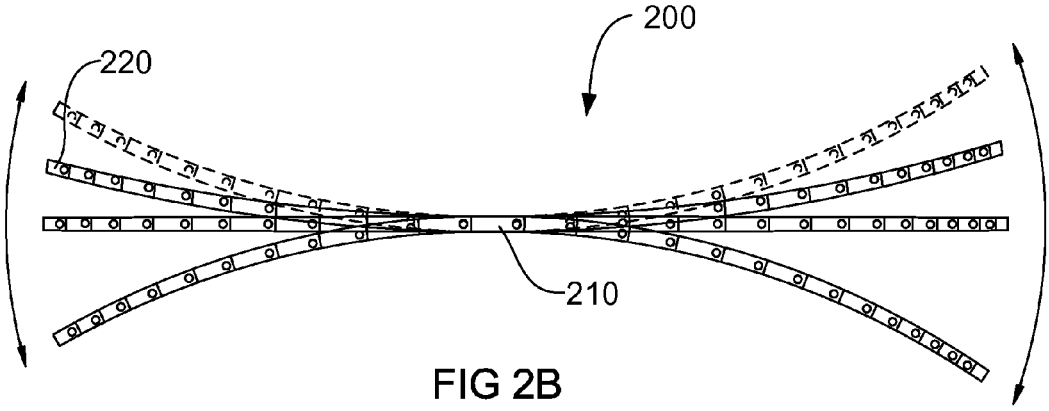
FIG 2B
FIG 3
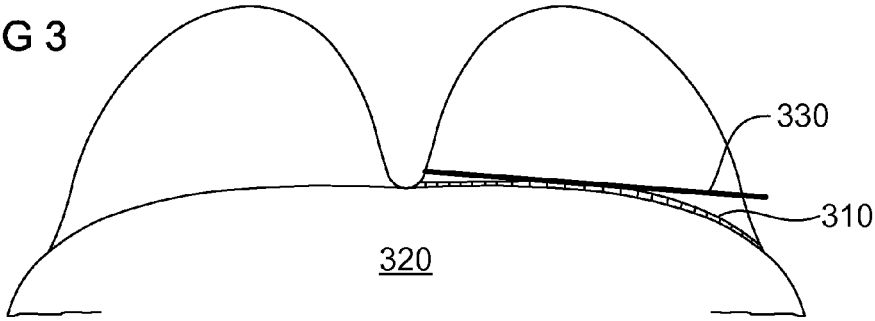

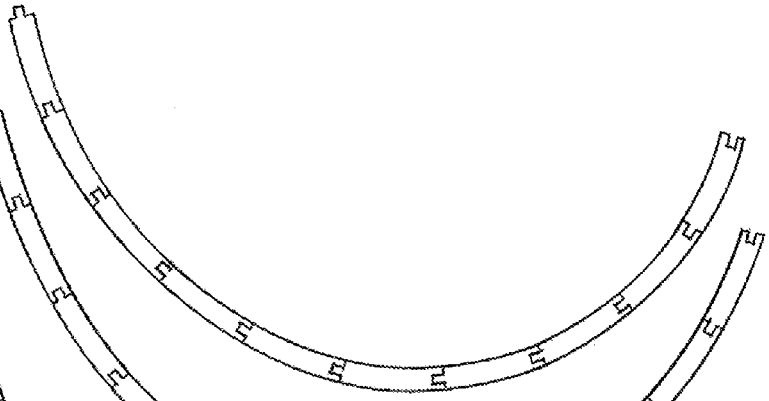
FIG 7A
FIG 7B
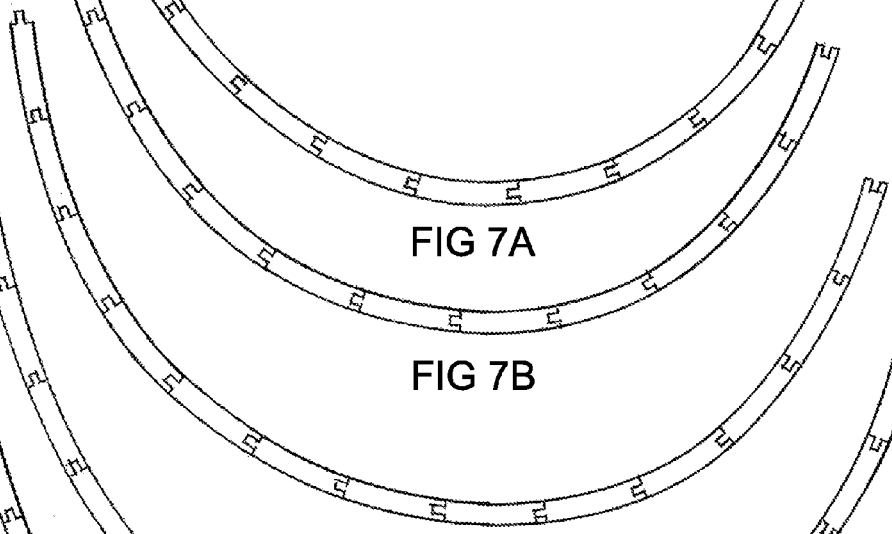
FIG 7C
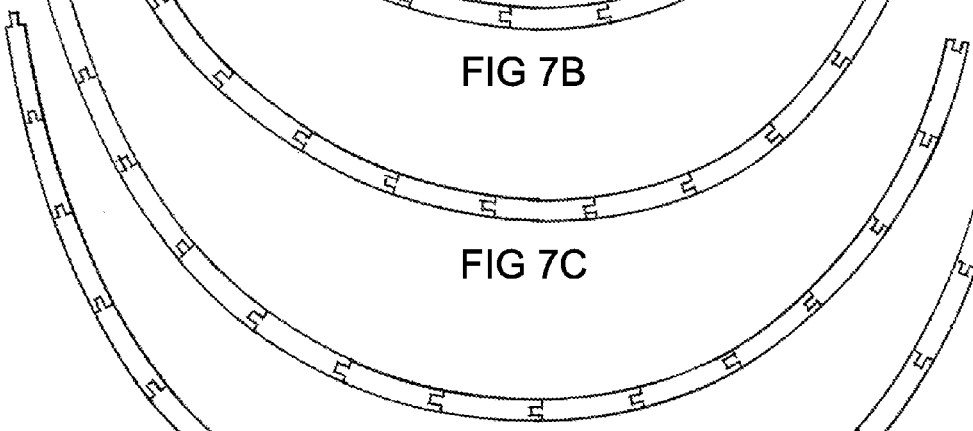
FIG 7D
FIG 7E

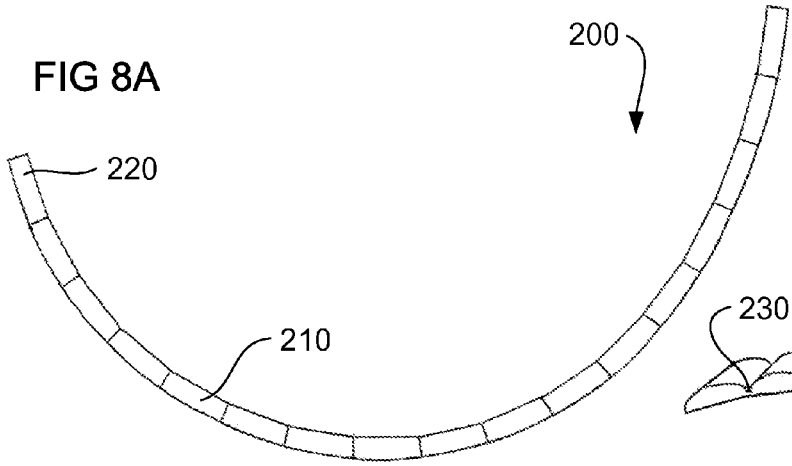
FIG 8A
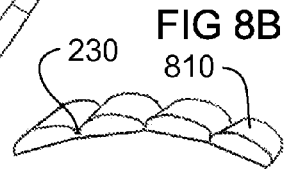
FIG 8B
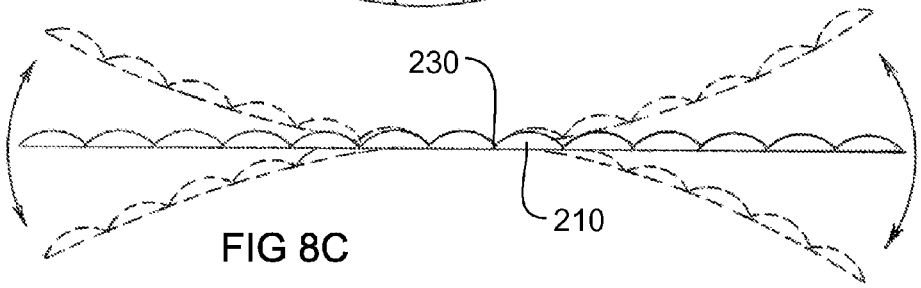
FIG 8C
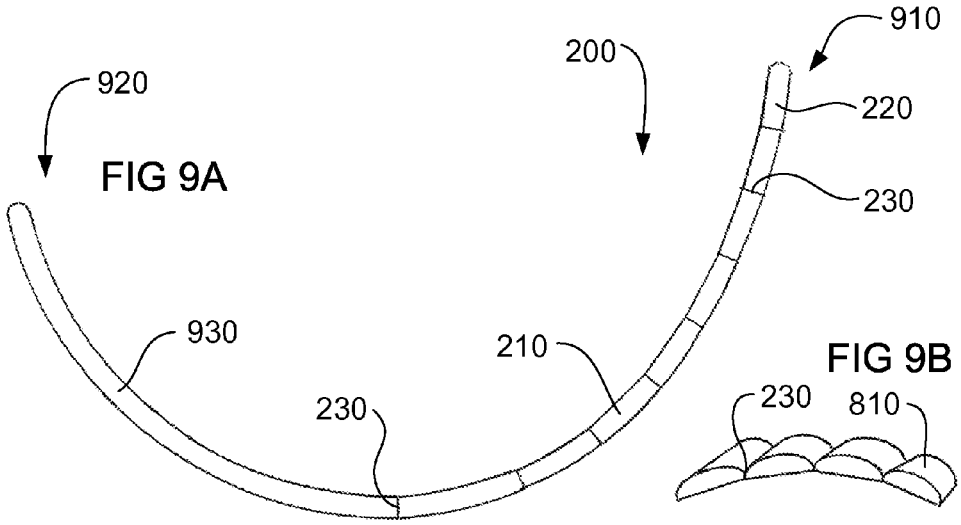
FIG 9A
FIG 9B
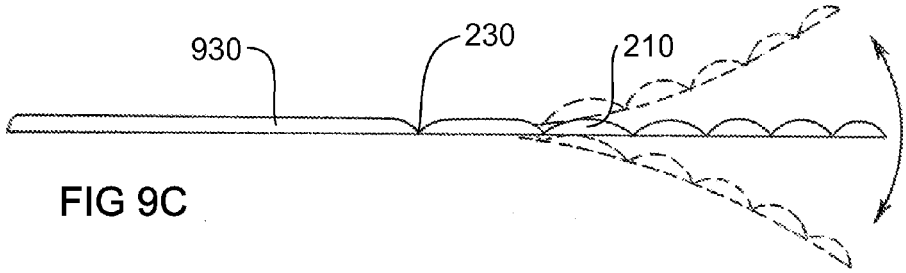
FIG 9C

UNDERWIRE FOR A BRASSIERE

FIELD OF THE INVENTION

The present invention relates generally to brassieres. More particularly, the present invention relates to an improved underwire for use in a brassiere or similar undergarment including swimwear. A brassiere incorporating the improved underwire is also provided.

BACKGROUND TO THE INVENTION

A conventional brassiere comprises of a pair of breast cups intended to cover and support the breasts of the wearer, a connector securing together the inner edges of the cups at the wearer's cleavage, and at least one strap-like back or wing that extends from outer edges of the breast cups around the back of the wearer. The brassiere may further include shoulder straps that extend from upper edges of the breast cups over the shoulders of the wearer to attachment points on the strap-like back or wing crossing the wearer's back.

It also standard to use an underwire to shape and support the lower periphery of each breast cup. An underwire typically consists of a U-shaped frame formed from metal or a rigid plastic material. Usually a pair of underwires is incorporated into a brassiere or similar undergarment to provide shape and support to a pair of breast cups. However, in some forms the underwire may comprise a single underwire frame which traverses both breast cups.

An underwire generally comprises a continuous planar piece of wire. Although underwires are typically formed from material providing a certain degree of flexibility to allow the underwire to assume the general shape of the wearer's figure by virtue of the forces applied to the underwire when the back strap or wings of the brassiere are fastened around the wearer's torso, the substantially rigid nature of the material used to form the underwire results in a less than even pressure being exerted on the wearer's figure.

It would be desirable to maximise the wearer's comfort by providing an improved underwire which more closely conforms to the shape of the wearer's figure.

Other objects and advantages of the invention will become apparent to those of ordinary skill in the art having reference to the following specification together with its drawings.

SUMMARY OF THE INVENTION

According to an aspect of the present invention, there is provided an underwire for a brassiere comprising:

a plurality of linkage elements;

each linkage element connected to at least one adjacent linkage element via a joint;

at least one joint allowing for movement of the connected linkage element with respect to its adjacent linkage element;

wherein movement of at least one connected linkage element with respect to its adjacent linkage element allows the underwire to more closely assume the curvature of a wearer's figure.

The connected linkage element may move with respect to its adjacent linkage element substantially through a single plane.

Preferably, more than one joint allows for movement of the connected linkage element with respect to its adjacent linkage element.

More preferably, each joint allows for movement of the connected linkage element with respect to its adjacent linkage element.

The underwire may comprise more than one type of linkage element, each type of linkage element differing from an alternate type of linkage element by a degree of curvature in the linkage element.

In one particular form of the invention, the underwire comprises at least four types of linkage elements, each type of linkage element differing from an alternate type of linkage element by a degree of curvature in the linkage element.

Each linkage element may include first and second ends, the first end having a male component configured for insertion to a complementarily configured female component in the second end of an adjacent linkage element.

The first and second ends may further each include an opening extending transversely across the end, such that when the male component of the first end is received in the female component of the second end of an adjacent linkage element, the opening through the first end is substantially aligned with the opening in the second end, and the first and second ends of adjacent linkage elements are secured together by means of a pin configured to fit into the opening extending transversely across both ends.

The pin may provide for rotation of the linkage element with respect to its adjacent linkage element to enable movement through a single plane.

In an alternative embodiment, the underwire is a single piece of a resilient material and the linkage elements and the joints are each a portion of the piece of resilient material. The at least one joint allowing for movement of the connected linkage element with respect to its adjacent linkage element comprises a thinned region of the piece of resilient material to allow such movement. In this embodiment, the joints are integral to the plurality of linkage elements forming a one-piece structure of the underwire.

According to another aspect of the present invention, there is provided a brassiere comprising:

a pair of breast cups;

a connector securing together an inner edge of each of the breast cups;

a back wing or pair of back wings for securing the brassiere to a torso of a wearer;

an underwire disposed about a lower periphery of each breast cup, the underwire comprising:

a plurality of linkage elements;

each linkage element connected to at least one adjacent linkage element via a joint;

at least one joint allowing for movement of the connected linkage element with respect to its adjacent linkage element;

wherein movement of each connected linkage element with respect to its adjacent linkage element allows the underwire to more closely assume the curvature of a wearer's figure.

The connected linkage element of the underwire may move with respect to its adjacent linkage element substantially through a single plane.

Preferably, more than one joint allows for movement of the connected linkage element with respect to its adjacent linkage element.

More preferably, each joint allows for movement of the connected linkage element with respect to its adjacent linkage element.

The underwire may comprise more than one type of linkage element, each type of linkage element differing from an alternate type of linkage element by a degree of curvature in the linkage element.

In one particular form of the invention, the underwire comprises at least four types of linkage elements, each type of linkage element differing from an alternate type of linkage element by a degree of curvature in the linkage element.

Each linkage element of the underwire may include first and second ends, the first end having a male component configured for insertion to a complementarily configured female component in the second end of an adjacent linkage element.

The first and second ends may further include an opening extending transversely across the end, such that when the male component of the first end is received in the female component of the second end of an adjacent linkage element, the opening through the first end is substantially aligned with the opening in the second end, and the first and second ends of adjacent linkage elements are secured together by means of a pin configured to fit into the opening extending transversely across both ends.

The pin may provide for rotation of the linkage element with respect to its adjacent linkage element to enable movement through a single plane.

In an alternative embodiment, the underwire is a single piece of a resilient material and the linkage elements and the joints are each a portion of the piece of resilient material. The at least one joint allowing for movement of the connected linkage element with respect to its adjacent linkage element comprises a thinned region of the piece of resilient material to allow such movement. In this embodiment, the joints are integral to the plurality of linkage elements forming a one-piece structure of the underwire.

BRIEF DESCRIPTION OF THE DRAWINGS

It will be convenient to hereinafter describe the invention in greater detail by reference to the accompanying figures which facilitate understanding of this invention. The particularity of the figures and the related description is not to be understood as superseding the generality of the broad identification of the invention as given in the attached claims.

FIG. 2A is a front view showing an underwire according to an embodiment of the present invention.

FIG. 2B is a top view of the underwire of FIG. 2A.

FIG. 3 is a schematic cross sectional view of a wearer's torso showing how the underwire conforms to the wearer's figure in accordance with the present invention.

FIGS. 7A to 7E are front views of various underwire configurations that can be achieved in accordance with the present invention.

FIGS. 8A, 8B and 8C are front views showing an underwire according to an alternative embodiment of the present invention.

FIGS. 9A, 9B and 9C are front views showing an underwire according to a modified version of the under wire of FIGS. 8A, 8B and 8C.

DETAILED DESCRIPTION

Figure 1:
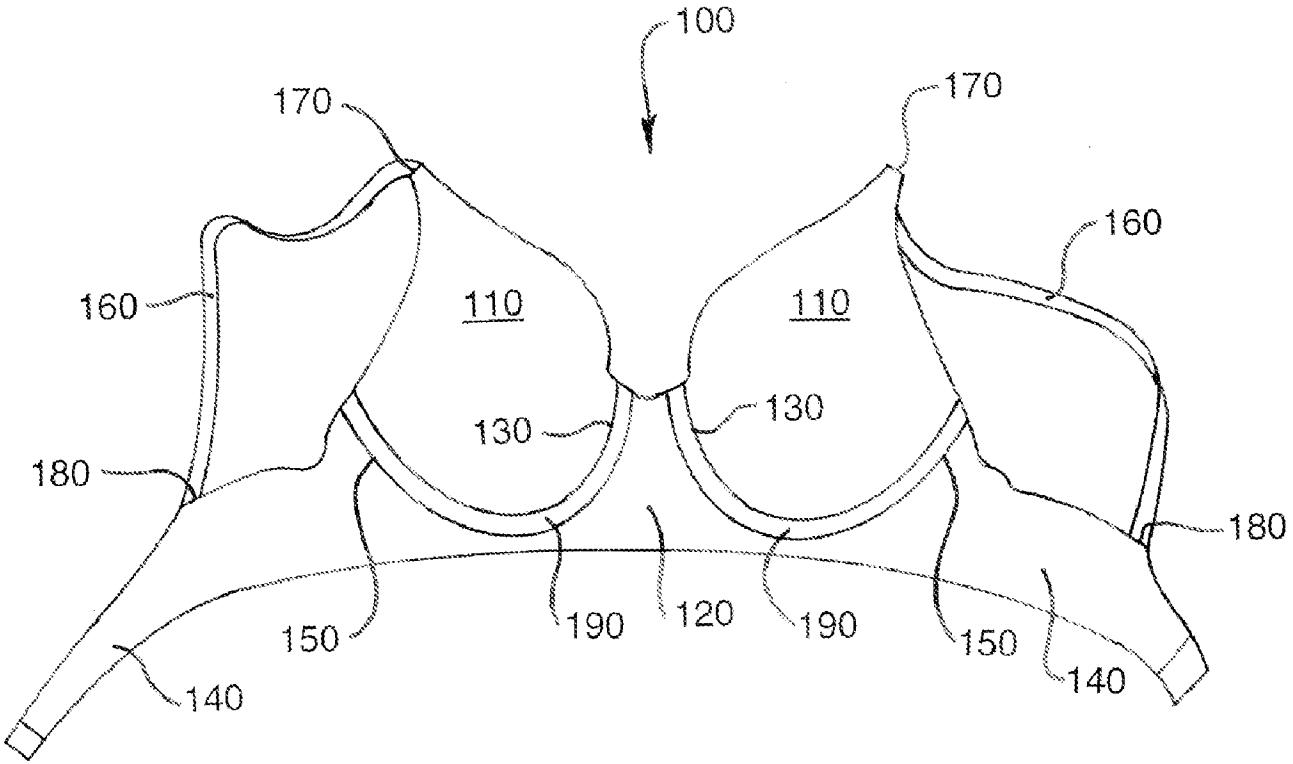
FIG 1 (PRIOR ART)
FIG. 1 is a schematic drawing of a typical brassiere.

Referring firstly to FIG. 1, there is shown a typical brassiere 100 comprising a pair of breast cups 110 intended to cover and support the breasts of the wearer, a connector 120 securing together the inner edges of the cups 130 at the wearer's cleavage, and at least one strap-like back or wing 140 that extends from the outer edges 150 of the breast cups around the back of the wearer. The brassiere 100 may further include shoulder straps 160 that extend from upper edges 170 of the breast cups 110 over the shoulders of the wearer to attachment points 180 on the back wing or wings 140 crossing the wearer's back. The brassiere 100 further includes a pair of substantially U-shaped underwires to shape and support the lower periphery 190 of each breast cup 110.

Referring now to FIG. 2A, there is shown an underwire in accordance with the present invention. The underwire 200 consists of a number of linkage elements 210 connected together to form the underwire. Each linkage element 210 is connected to at least one adjacent linkage element. That is, the linkage elements 220 located at either end of the underwire 200 are each connected only to one adjacent linkage element 210, whilst each linkage element therebetween is connected to an adjacent linkage element at both ends. The linkage elements 210, 220 may be discrete linkage elements or may be formed from and be portions of a one-piece structure of the underwire 200.

In one embodiment, the linkage elements 210, 220 are discrete linkage elements. The individual linkage elements can be formed from various materials including metal, alloy materials or a hard plastic such as ABS (Acrylonitrile Butadiene Styrene) or the like.

At least one of the joints 230 (and see FIGS. 5A and 5B) formed between connected linkage elements 210 are formed so as to permit movement of the linkage element with respect to its adjacent linkage element. This movement confers the advantage of enabling the underwire 200 as a whole to more closely conform to the curvature of the wearer's figure by permitting movement of at least one linkage element 210 along the length of the underwire with respect to its adjacent linkage elements or elements. The more joints permitting movement, the more substantially the underwire can conform to the figure of the wearer.

Referring now to FIG. 2B, the connected linkage elements 210, 220 move substantially through a single plane with respect to their adjacent linkage elements. That is, if the underwire 200 was considered to lie in an xy plane, the movement between the linkage elements 210, 220 occurs substantially in the z plane. This assumes that FIG. 2A shows the underwire in the xy plane, and FIG. 2B shows the same underwire in the z plane, the z plane being substantially perpendicular to the xy plane.

Referring now to FIG. 3, the movement between the linkage elements 210, 220 is shown in an underwire 310 which has conformed to the FIG. 320 of a wearer in accordance with the present invention. FIG. 3 further shows the position of a conventional underwire 330 which exhibits little flexibility and is therefore unable to substantially assume the curvature of the figure of a wearer. The inherent flexibility in the underwire of the present invention is a particular advantage since the actual shape and curvature of a wearer's figure will vary from individual to individual. The underwire provides means of ensuring a customised brassiere fit using a mass producible underwire. The configuration of the underwire of the present invention ensures that the underwire exerts an even pressure against the wearer's figure enhancing comfort and function of the brassiere incorporating the inventive underwire.

Figure 4A:
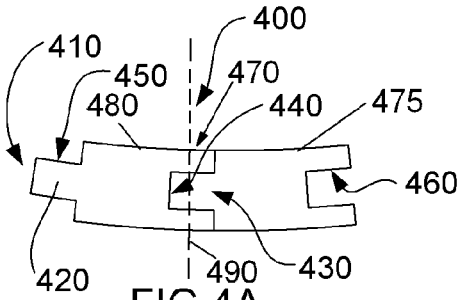
FIGS. 4A and 4B are front and top views respectively of the linkage elements.
Figure 4B:
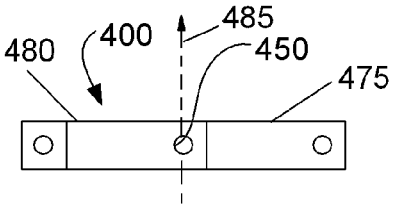

FIGS. 4A and 4B show a close up view of the connected linkage elements. FIG. 4A shows a front view of the linkage elements. Each linkage element 400 has two ends. The first end 410 has a male component 420 and the second end 430 has a female component 440 configured to be a complementary shape to the male component of the first end, so as to receive the male component within the female component.

The linkage elements 400 can be secured together by any suitable means and may take other forms in alternative embodiments. One means of securing the linkage elements 400 together is by providing an opening 450 extending transversely across each end 410, 430 of the linkage element, so that when the male component 420 of the first end 410 is received in the female component 440 of the second end 430 of an adjacent linkage element, the opening through the first end is substantially aligned with the opening through the second end. The joint 470, which includes male component 420, female component 440, and openings 450 through the male component 420 and the female component 440, between adjacent linkage elements 475, 480 is such that joint 470 does not cause adjacent linkage elements 475, 480 to overlap each other in a direction 485 perpendicular to the longitudinal axis 490 of joint 470.

Figure 5A:
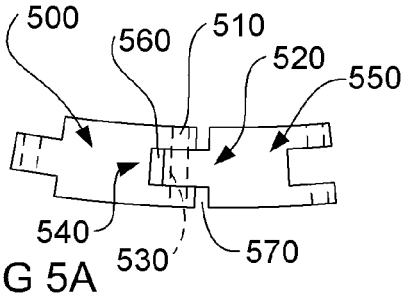
FIGS. 5A and 5B are front and top views respectively of the linkage elements in more detail.

Now referring to FIG. 5A the alignment of the opening 510 through the second end 520 of a linkage element 500 with the opening 530 through the first end 540 of an adjacent linkage element 550 is shown. A pin (not shown) which may be tapered to facilitate locking of the pin within the opening 510, 530 is inserted into the opening to secure the adjacent linkage 500, 550 elements together. Use of a pin or similar connector permits rotational movement of the linkage element with respect to its adjacent linkage element allowing the underwire to more closely conform to the figure of a wearer. Provision of a small gap 560, 570 between adjacent linkage elements allows rotation of the linkage element 550 about the pin.

Figure 5B:
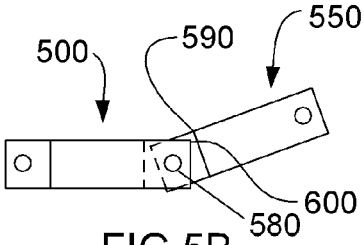

Referring to FIG. 5B, there is shown a top view of the connected linkage elements of FIG. 5A showing rotation of linkage element 550 with respect to its adjacent linkage element 500 about the pin 580 until the edge 590 of linkage element 550 touches the edge 600 of linkage element 500 thereby preventing further rotation.

Of course other means of joining the linkage elements may be suitable such as for example a recess or protrusion provided on either side 450 of the male component 420 to receive or be received (as the case may be) into a corresponding protrusion or recess provided on an inner surface 460 of the female component 440.

Figure 10:
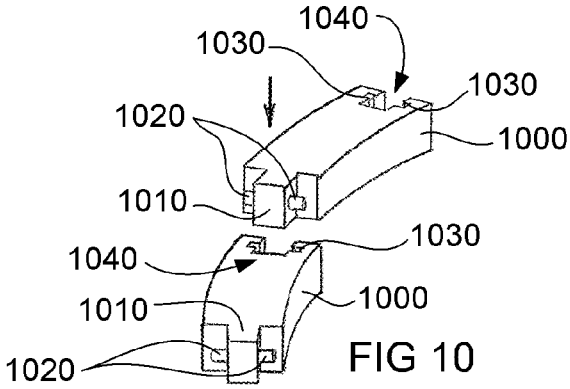
FIG. 10 is a perspective view of the linkage elements showing an alternate means for securing the linkage elements together.

One example of such a configuration is shown in FIG. 10. In this case, the male component 1010 of the linkage element 1000 includes an integral pin 1020 or similar protrusion to be received into a complementary recess 1030 provided in the female component 1040. This configuration enables adjacent linkage elements 1000 to be secured together whilst allowing rotational movement of a linkage element with respect to its adjacent linkage element.

Figure 6A:
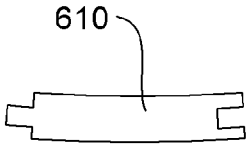
FIGS. 6A to 6D are front views of four different types of linkage elements.
Figure 6C:
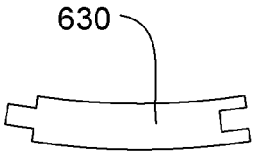
Figure 6B:
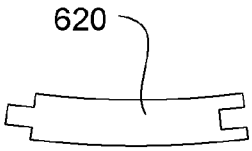
Figure 6D:
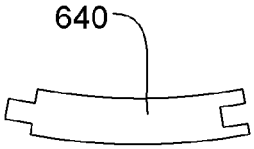

Referring now to FIGS. 6A to 6B the linkage elements come in various types, each type of linkage element differing from another type of linkage element by the degree of curvature in the linkage element. For instance linkage element 610 shown in FIG. 6A has a curvature (or radius) of approximately 135.8 millimeters; linkage element 620 shown in FIG. 6B has a curvature (or radius) of approximately 72.5 millimeters; linkage element 630 shown in FIG. 6C has a curvature (or radius) of approximately 62.5 millimeters; and, linkage element 640 shown in FIG. 6D has a curvature (or radius) of approximately 51.8 millimeters. The length of each linkage element is approximately 15.8 millimeters.

Use of various combinations of linkage elements 610, 620, 630, 640 of different curvature enables production of an underwire to suit various breast cup shapes and sizes, e.g. 32B, 34B, 36B, 36C, 36D as shown in FIGS. 7A to 7E. The number and type of linkage elements required to produce an underwire of a particular size and shape is determined largely by trial and error. That is, assuming the desired shape and size of the underwire is known, the existing linkage elements of different types (optimally there will be four or five different types of linkage element each having a fixed size and curvature) are connected to produce an underwire of the desired size and shape by approximation. For instance the desired shape and size can be divided into a plurality of segments and the type of linkage element that is closest to the segment size and shape will be used for the corresponding segment of the inventive underwire. This approximation may be carried out manually but will more preferably involve use of suitable computer software to optimise the combination of linkage element types to attain an underwire of the desired shape and size.

Referring now to FIG. 8A, there is shown an alternative embodiment wherein the underwire 200 is a one-piece structure. Here, the linkage elements 210, 220 are each formed from a portion of a single piece of resilient material such as a plastic and each joint 230 comprises a thinned region of that piece of resilient material. Thinning the material in the joint region 230 between linkage elements 210, 220 permits the joint 230 to allow movement of one linkage element 210 with respect to its adjacent linkage element 220. Since the linkage elements 210, 220 and the joints 230 are formed from the same piece of material, the underwire 200 is a one-piece structure with the joints 230 being integral to the linkage elements 210, 220.

FIG. 8B shows an enlarged view of interconnected linkage elements 210, 220 showing a curved profile 810 of the linkage element which gives rise to the thinned region or integral joint 230. FIG. 8C is a top view showing the extent of movement between linkage elements 210, 220 and the resultant flexibility of the underwire. As in FIG. 2B, it can be seen that the connected linkage elements 210, 220 move substantially through a single plane with respect to their adjacent linkage elements.

Referring now to FIG. 9A there is shown a variation of the underwire 200 shown in FIGS. 8A, 8B and 8C in that the interconnected linkage elements 210, 220 are more prevalent at the end of the underwire 910 which lies in proximity to the wearer's armpit during wear, to provide a maximum degree of flexibility for enhanced comfort. The opposing end of the underwire 920 which lies distal from the wearer's armpit during wear has no or few discrete yet interconnected linkage elements 930 since a high degree of flexibility is not necessarily optimal in this region.

The one-piece underwire as shown in FIG. 8A or FIG. 9A is formed from a resilient and preferably light weight material such as plastic; for example, polypropylene or an impact resistant polypropylene copolymer made by blending polypropylene with ethylene-propylene-rubber or similar material.

The underwire of the present invention is suitable for use in a variety of undergarments such as a brassiere. Like a conventional underwire, the inventive underwire is preferably encased in a sheath and can be sewn to a breast cup or be embedded in a moulded breast cup via a typical moulding process.

It is an advantage of the present invention that a mass produced underwire can provide a customised fit to the wearer due to the function of at least one or more of the joints between the linkage elements comprising the underwire to allow the underwire to conform closely to the shape of the wearer's figure. This improved fit provides more even distribution of pressure along the underwire against the wearer's skin and accordingly enhanced comfort and function.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

The invention claimed is:

1. An underwire for a brassiere comprising:

a plurality of linkage elements included in the underwire;

each linkage element being connected to at least one adjacent linkage element via at least one joint, the at least one joint not causing the connected linkage element to overlap the at least one adjacent linkage element in a direction perpendicular to a longitudinal axis of the at least one joint; and the at least one joint allowing for movement of at least one of the connected linkage elements with respect to its at least one adjacent linkage element;

wherein movement of the at least one of the connected linkage elements with respect to its at least one adjacent linkage element allows the underwire for the brassiere to more closely conform to a shape of a wearer's figure than a single piece underwire conforms to a shape of a wearer's figure.

2. An underwire for a brassiere according to claim 1, wherein the at least one of the connected linkage elements moves with respect to its at least one adjacent linkage element substantially through a single plane.

3. An underwire for a brassiere according to claim 1, wherein more than one joint allows for movement of each linkage element connected to at least one of the more than one joint with respect to its at least one adjacent linkage element.

4. An underwire for a brassiere according to claim 1, wherein each joint allows for movement of the connected linkage element with respect to its at least one adjacent linkage element.

5. An underwire for a brassiere according to claim 1, wherein the plurality of linkage elements comprise more than one type of linkage element, each type of linkage element differing from another type of linkage element by a degree of curvature in the linkage element.

6. An underwire for a brassiere according to claim 1, wherein the plurality of linkage elements comprise at least four types of linkage elements, each type of linkage element differing from another type of linkage element by a degree of curvature in the linkage element.

7. An underwire for a brassiere according to claim 1, wherein each linkage element includes first and second ends, the first end having a male component configured for insertion to a complementarily configured female component in the second end of an adjacent linkage element.

8. An underwire for a brassiere according to claim 7, wherein the first and second ends each include an opening extending transversely across the end, such that when the male component of the first end is received in the female component of the second end of an adjacent linkage element, the opening through the first end is substantially aligned with the opening in the second end, and the first and second ends of adjacent linkage elements are secured together by means of a pin configured to fit into the opening extending transversely across both ends.

9. An underwire for a brassiere according to claim 8, wherein the pin provides for rotation of the one linkage element with respect to its adjacent linkage element to enable movement through a single plane.

10. An underwire for a brassiere according to claim 1, wherein the underwire for the brassiere is a single piece of a resilient material and the linkage elements and the joints are each a portion of the piece of resilient material, and wherein the at least one joint allowing for movement of the connected linkage element with respect to its adjacent linkage element comprises a thinned region of the piece of resilient material to allow such movement.

11. A brassiere comprising:

a pair of breast cups;

a connector securing together an inner edge of each of the breast cups;

a back wing or pair of back wings for securing the brassiere to a torso of a wearer;

an underwire disposed about a lower periphery of each breast cup including:

a plurality of linkage elements included in the underwire;

each linkage element being connected to at least one adjacent linkage element via at least one joint, the at least one joint not causing the connected linkage element to overlap the at least one adjacent linkage element in a direction perpendicular to a longitudinal axis of the at least one joint; and the at least one joint allowing for movement of at least one of the connected linkage elements with respect to its at least one adjacent linkage element;

wherein movement of at least one of the connected linkage elements with respect to its at least one adjacent linkage element allows the underwire of the brassiere to more closely conform to a shape of a wearer's figure than a single piece underwire conforms to a shape of a wearer's figure.

12. A brassiere according to claim 11, wherein the at least one of the connected linkage elements of the underwire of the brassiere moves with respect to its at least one adjacent linkage element substantially through a single plane.

13. A brassiere according to claim 11, wherein more than one joint allows for movement of each linkage element connected to at least one of the more than one joint with respect to its at least one adjacent linkage element.

14. A brassiere according to claim 11, wherein each joint allows for movement of the connected linkage element with respect to its at least one adjacent linkage element.

15. A brassiere according to claim 11, wherein the plurality of linkage elements comprise more than one type of linkage element, each type of linkage element differing from another type of linkage element by a degree of curvature in the linkage element.

16. A brassiere according to claim 11, wherein the plurality of linkage elements comprise at least four types of linkage elements, each type of linkage element differing from another type of linkage element by a degree of curvature in the linkage element.

17. A brassiere according to claim 11, wherein each linkage element of the underwire includes first and second ends, the first end having a male component configured for insertion to a complementarily configured female component in the second end of an adjacent linkage element.

18. A brassiere according to claim 17, wherein the first and second ends each include an opening extending transversely across the end, such that when the male component of the first end is received in the female component of the second end of an adjacent linkage element, the opening through the first end is substantially aligned with the opening in the second end, and the first and second ends of adjacent linkage elements are secured together by means of a pin configured to fit into the opening extending transversely across both ends.

19. A brassiere according to claim 18, wherein the pin provides for rotation of the linkage element with respect to its adjacent linkage element to enable movement through a single plane.

20. A brassiere according to claim 11, wherein the underwire of the brassiere is a single piece of a resilient material and the linkage elements and the joints are each a portion of the piece of resilient material, and wherein the at least one joint allowing for movement of the connected linkage element with respect to its adjacent linkage element comprises a thinned region of the piece of resilient material to allow such movement.

* * * * *